United States Patent [19]

Bolli et al.

[11] 4,151,081

[45] Apr. 24, 1979

[54] PROCESS AND PLANT FOR HYDROMECHANICAL RECOVERY OF A FLUID SPREAD IN A THIN LAYER ON THE SURFACE OF ANOTHER LIQUID

[75] Inventors: Peter Bolli, Geneva; Jean-Jacques Asper, Croix-de-Rozon, both of Switzerland

[73] Assignee: Seaclean SA, Luxembourg

[21] Appl. No.: 707,047

[22] Filed: Jul. 20, 1976

Related U.S. Application Data

[63] Continuation of Ser. No. 258,242, May 31, 1972, abandoned.

[30] Foreign Application Priority Data

Jun. 4, 1971 [CH] Switzerland ..... 819571/71

[51] Int. Cl.[2] ..... E02B 15/04

[52] U.S. Cl. ..... 210/83; 210/DIG. 25; 210/242 S

[58] Field of Search ..... 210/83, 242, DIG. 25, 210/525

[56] References Cited

U.S. PATENT DOCUMENTS

| | | | |
|---|---|---|---|
| 2,249,049 | 7/1941 | Sayers et al. | 210/525 |
| 3,365,395 | 1/1968 | McDonald | 210/83 X |
| 3,447,683 | 6/1969 | Luke, Jr. | 210/83 |
| 3,536,199 | 10/1970 | Cornelius | 210/DIG. 25 |
| 3,552,571 | 1/1971 | Neuspiel | 210/525 |
| 3,618,768 | 11/1971 | Brown | 210/83 |
| 3,637,080 | 1/1972 | Markel | 210/DIG. 25 |
| 3,666,099 | 5/1972 | Gellug | 210/DIG. 25 |

FOREIGN PATENT DOCUMENTS

| | | | |
|---|---|---|---|
| 1314495 | 2/1963 | France | 210/DIG. 21 |

*Primary Examiner*—Theodore A. Granger
*Attorney, Agent, or Firm*—Robert E. Burns; Emmanuel J. Lobato; Bruce L. Adams

[57] ABSTRACT

A process and plant for hydromechanical recovery of a fluid spread in a thin layer on the surface of a liquid in which predetermined portions of the liquid and superimposed fluid are successively partitioned off, enclosed in a cell of variable cross section and each portion is progressively restricted in volume by reducing the cross-sectional area of the cell to increase the thickness of the layer of contaminant fluid which is then removed.

26 Claims, 19 Drawing Figures

PROCESS AND PLANT FOR HYDROMECHANICAL RECOVERY OF A FLUID SPREAD IN A THIN LAYER ON THE SURFACE OF ANOTHER LIQUID

This is a continuation, of application Ser. No. 258,242, filed May 31, 1972, now abandoned.

This invention relates to a process and plant for hydromechanical recovery of at least a portion of a fluid spread in a thin layer on the surface of liquid, which is immiscible with the fluid.

The problem of removing a fluid, particularly a liquid spread in a thin layer on the surface of another liquid of a much greater thickness has acquired great importance since one has realized the serious danger constituted by the general increase of water contamination. Such contamination often leads to the formation of a thin layer of one or more contaminating liquids on the surface of the water, these contaminating liquids being immiscible with the water below and therefore being either in a pure state or in the state of an emulsion with the water. When rivers, lakes or the sea are contaminated by petroleum products the contaminant often forms, at least in the initial stage of contamination, a very thin and extensive layer of "pure" contaminant which is not emulsified with the water below. But very soon, mainly due to the effect of swells and the wind, the contaminant forms an emulsion and it is no longer a "liquid" but becomes a "fluid." This happened in the case of catastrophes caused by shipwrecked tankers or by accidents in the operation of submarine petroleum extraction plants or in liquid hydrocarbon transfer and treatment plants.

The same problem occurs in the purification of waste water, particularly waste water coming from highly industrialized regions. In this case the contaminant forms a layer in which it is emulsified with the water below, but this layer can only cover a relatively small area. In all these cases the fluid contaminant, which may or may not be liquid, and the underlying liquid are immiscible and the contaminant forms a thin layer on the surface of the underlying liquid which has a relatively great thickness. Therefore, it is difficult to separate the thin layer of contaminant from the underlying thick layer to recover the contaminant without taking particular measures for increasing the thickness of the contaminant layer. In effect, attempts have been made to remove the liquid contaminant with the aid of pumps having suction roses floating on the contaminating water surface, but the suction roses could not work well as the free contaminant surface is generally irregular in most cases of contaminated rivers, lakes and the sea which is agitated by the swells and the wind and in the case of purification plants the contaminant is agitated by the movement or stirring of the water.

Thus, before collecting the contaminant layer it is necessary to increase the thickness of this layer, usually by hydrodynamic means. Particularly the damming effect produced by an obstacle has been utilized, for example, a sausage-shaped floating roll placed in the form of a V on the surface of the liquid with the opening of the V in front to collect the liquid contaminant at the vertex of the triangle formed by the V. In this manner the liquid contaminant can be removed by pumping or by causing it to flow over a waste-weir into a recovery basin arranged behind the vertex of the V. Such a system is described, for example, in French Pat. No. 2,042,260. Also the vortex effect which is produced when a finite mass of liquid is set into rotation has been utilized. This effect produces a deformation of the free surface of the liquid, causing the free surface to form a hollow in the centre of the vortex produced by rotation of the liquid. When the liquid is covered with a contaminant layer, the thickness of such layer increases from the periphery toward the centre of the vortex. So the contaminant can be pumped off through a suction rose placed in the centre of the vortex. However, the range of action which can be technically obtained by the vortex effect is relatively small.

According to another solution, described in Russian Pat. No. 256,650, it is proposed to suck off the liquid contaminant with the aid of a flat sucker immerged into the underlying liquid near the interface between contaminant and the underlying liquid. By sucking in the liquid a hollow is produced in the centre of the sucker, similar to that of a vortex and the contaminant collects in the centre of the hollow in the form of a column and is pumped off through a suction hose placed at the bottom of the column.

The process proposed by the present invention is a hydromechanical "skimming" process which works both mechanically and hydrodynamically and is suitable for treating both large contaminated surfaces such as out at sea or in ports, and relatively small contaminated surfaces such as in purification plants.

The process according to the invention comprises the steps of partitioning off at least one portion of the liquid and superimposed fluid up to a depth exceeding the interface between the fluid and liquid, reducing the area of the partitioned portion to increase the thickness of the layer of fluid, and recovering at least the major portion of the thickened layer of fluid.

The invention also provides a plant for carrying out the process, which comprises partitioning means adapted to be immerged into the liquid and superimposed fluid up to a depth exceeding the interface between the fluid and liquid so as to delimit at least one portion of both fluid and liquid, means for moving at least a portion of said partitioning means so as to reduce the area of the partitioned portion, and recovery means for recovering the fluid contained in said portion of reduced area.

The process according to the present invention, some embodiments of the plant for carrying out the process, and two examples of application of the process will now be described with reference to the accompanying drawings, in which.

Figure 12:
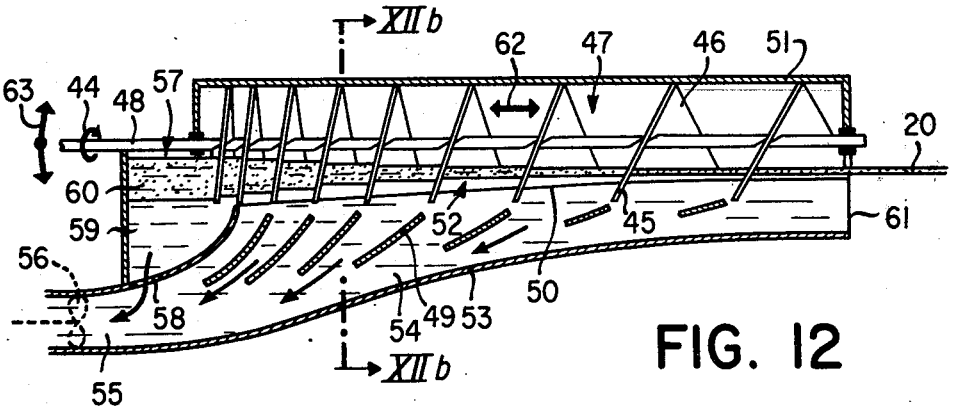
FIG. 12 is a schematic sectional view of a second embodiment of the plant for carrying out the process.
Figure 13:
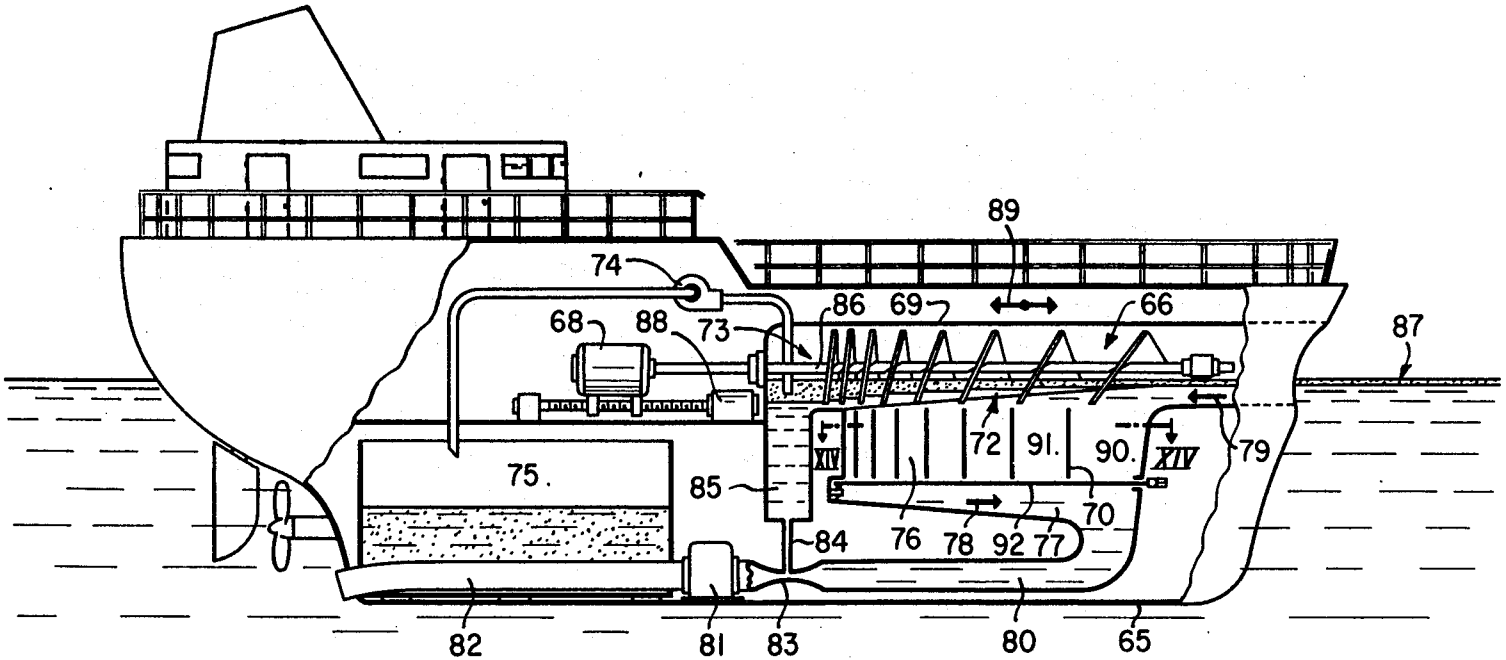
Figure 13B:
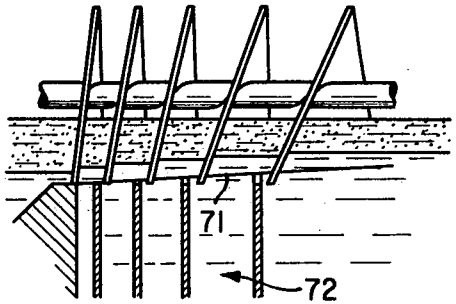
Figure 12B:
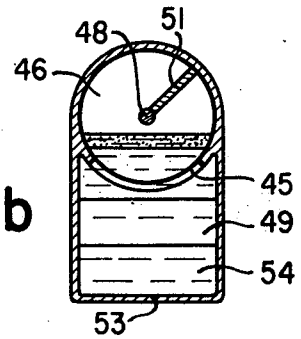
Figure 16:
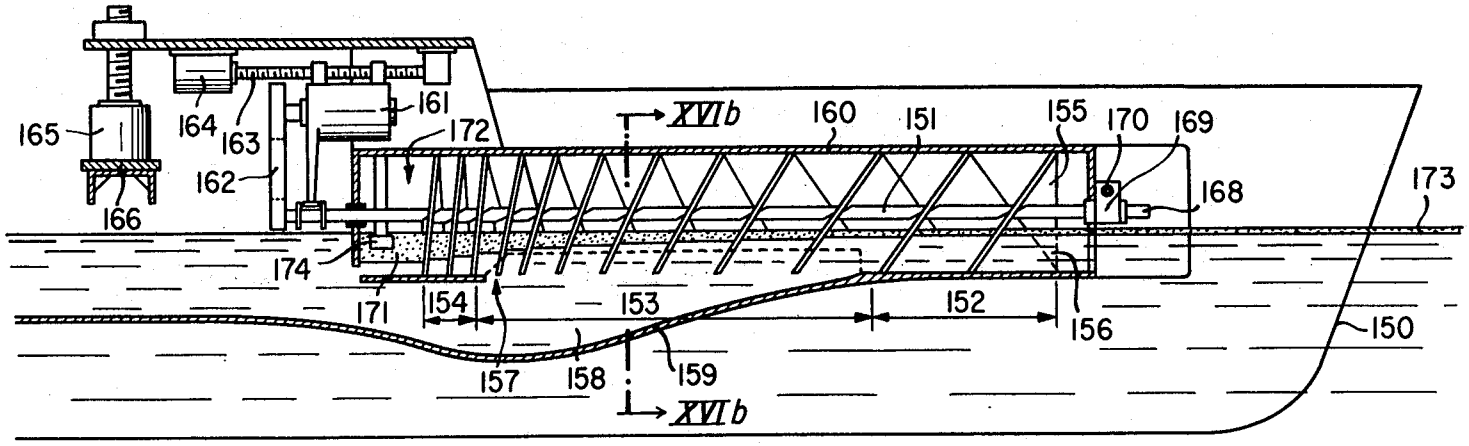
Figure 16B:
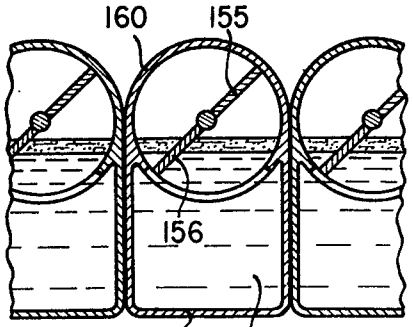
Figure 14:
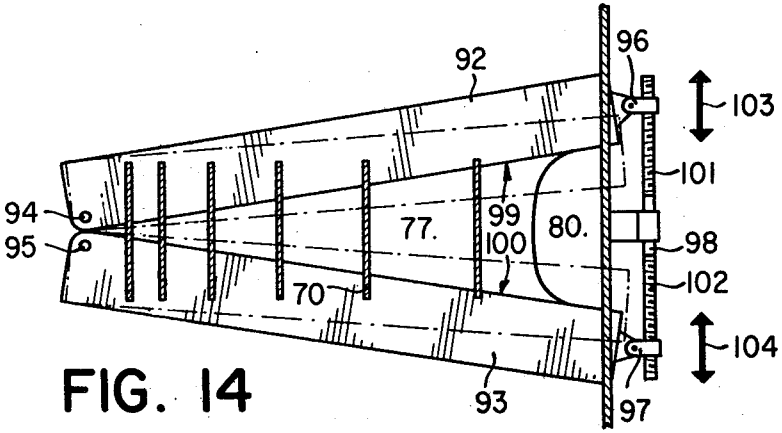
Figure 15:
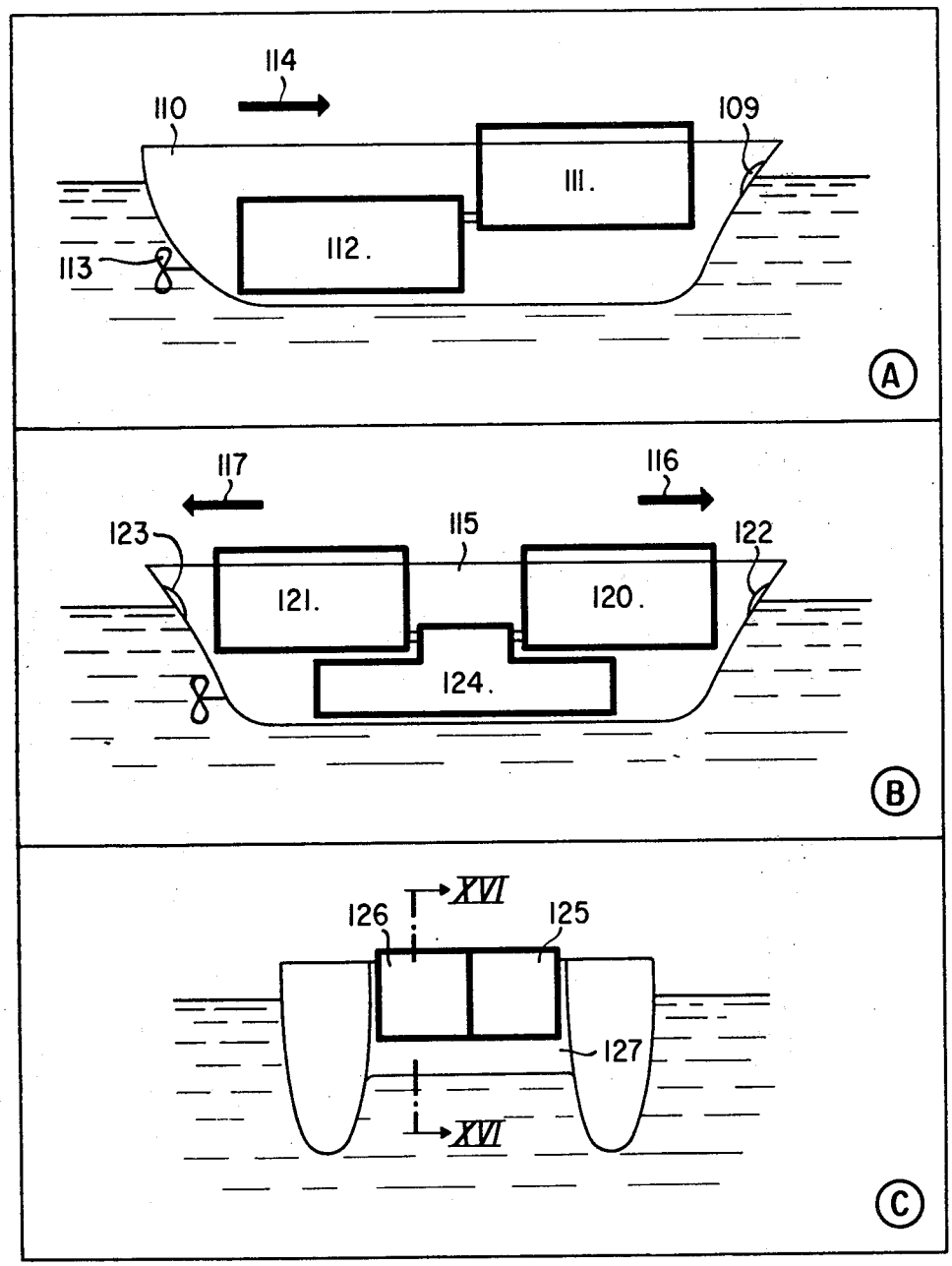

FIG. 12*b* is a cross section taken on the line XII—XII of FIG. 12;

FIG. 13 is a sectional view showing the second embodiment of the plant as adapted for a particular application;

FIG. 13*b* is a detail view showing part of FIG. 13 on a larger scale;

FIG. 14 is a plan view on a larger scale, showing part of FIG. 13;

FIG. 15 is a schematic representation of various modifications of the arrangement shown in FIG. 13;

FIG. 16 is a longitudinal section showing a modification to the second embodiment of the plant, and FIG. 16*b* is a cross section taken on the line XVI*b*—XVI*b* of FIG. 16.

Figure 1:
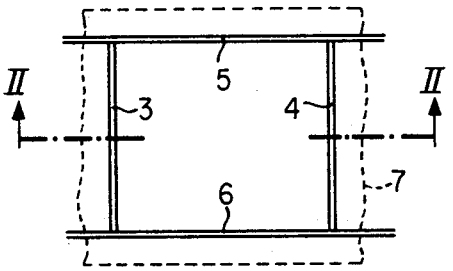
FIGS. 1 and 2 are diagrams illustrating a first step of the process, FIG. 1 being a plan view and FIG. 2 a cross-sectional view.
Figure 3:
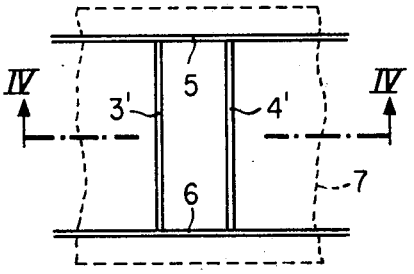
FIGS. 3 and 4 are diagrams illustrating a second step of the process, FIG. 3 being an plan view and FIG. 4 a cross-sectional view.
Figure 2:
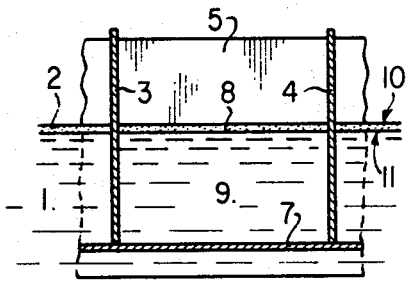
Figure 4:
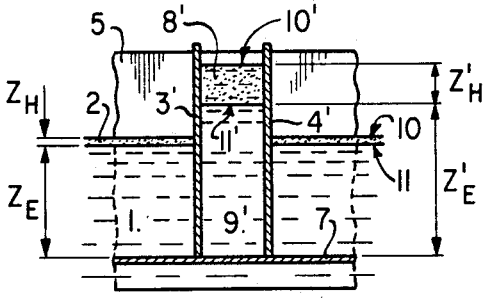

The process is based on the consideration that, as is schematically shown in FIGS. 1 and 2, if a portion of the contaminated liquid, for example, water 1 covered by a thin layer of oil 2 is separated, with the aid partitioning means comprising two movable walls 3 and 4, two fixed walls 5 and 6 and a bottom wall 7 and the movable walls are moved toward each other along the fixed walls and the bottom wall into the positions 3' and 4', respectively, shown in FIGS. 3 and 4, the thickness of the oil layer 8 thus enclosed is increased from an initial value $Z_H$ to a final value $Z_H'$. The height of the enclosed mass of water 9 as measured from the bottom 7 is likewise increased from the initial value $Z_E$ to the value $Z_E'$.

Figure 5:
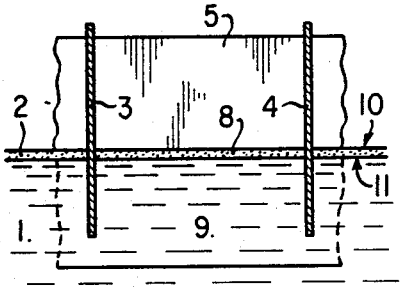
FIGS. 5 and 6 are cross-sectional views as FIGS. 2 and 4, illustrating a first form of carrying out the process between the first and a second step.
Figure 6:
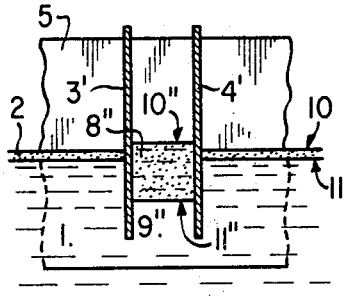

In the case illustrated in FIG. 4 it is assumed that there are no leaks between the movable walls 3', 4' and the fixed walls 5 and 6 or the movable walls and the bottom wall 7. Therefore, the free surface 10' of the enclosed contaminated liquid has risen above the free surface 10 of the contaminated liquid outside and the separating surface 11' between the water and oil has likewise risen above the level 11 at which this separating surface is located outside. If, as shown in FIGS. 5 and 6, there is free communication between the portion of isolated water 9'' and the water outside 1, the free surface 10'' of the enclosed contaminated liquid is nevertheless located at a higher level than the free surface 10 of the contaminated liquid outside whereas the separating surface 11'' is located below the level 11 at which it is located outside. This is due to the difference between the density of the oil and that of the water.

Figure 7:
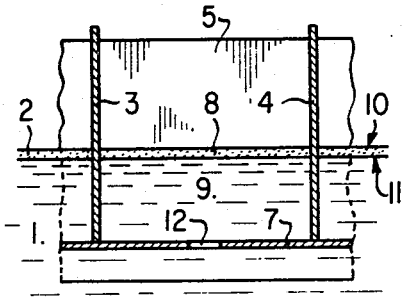
FIGS. 7 and 8 are cross-sectional view as FIGS. 2 and 4, illustrating a second form of carrying out the process between the first and the second step.
Figure 8:
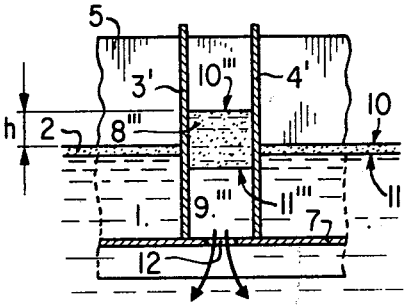

By providing a hole 12 in the bottom wall 7, as shown in FIGS. 7 and 8, through which the enclosed water 9''' can escape to the water outside 1, the height h of the free surface 10''' of the enclosed contaminated liquid above the free surface 10 of the contaminated liquid outside can be varied as desired as a function of time as this height only depends on the speed at which the movable walls 3 and 4 are moved toward each other, and on the diameter of the hole 12.

Figure 9:
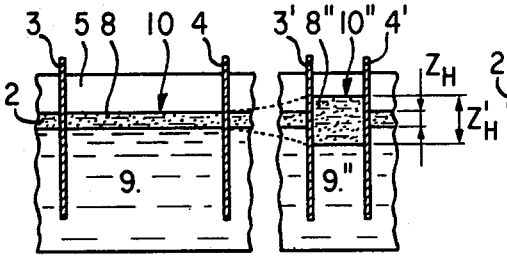
FIGS. 9 and 10 are diagrammatic cross-sectional views illustrating two extreme modifications of the process.
Figure 10:
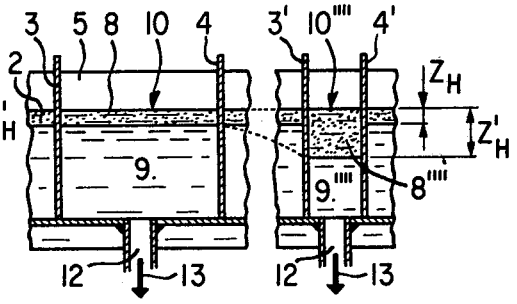

By drawing off the enclosed water 9', 9'', 9''' all the situations may arise between those schematically illustrated in FIGS. 9 and 10, FIG. 9 showing schematically the case in which there is simply free communication between the water outside 1 and the enclosed water 9'' and in which the free surface 10'' of the enclosed liquid is located above the free surface outside 10, and FIG. 10 showing the case in which the liquid is drawn off through the hole 12, as indicated by the arrow 13, and consequently the free surface 10'''' of the enclosed liquid is brought down to the level of the free surface outside 10. As is evident from the Figs., in both cases the thickness of the layer of liquid contaminant is increased from the value $Z_H$ outside to the value $Z_H'$ inside the "cell" formed by the partitioning means 3, 4, 5 and 6.

Thus, the invention consists in continuously and successively isolating portions of the contaminated liquid between the movable walls moving at variable speed between two fixed walls so as to form a succession of "cells" which, as they move along, become narrower and narrower, and in moving these cells along a "bottom" which permits the uncontaminated liquid contained in each cell to escape or to draw off this liquid as the cells move along.

Figure 11:
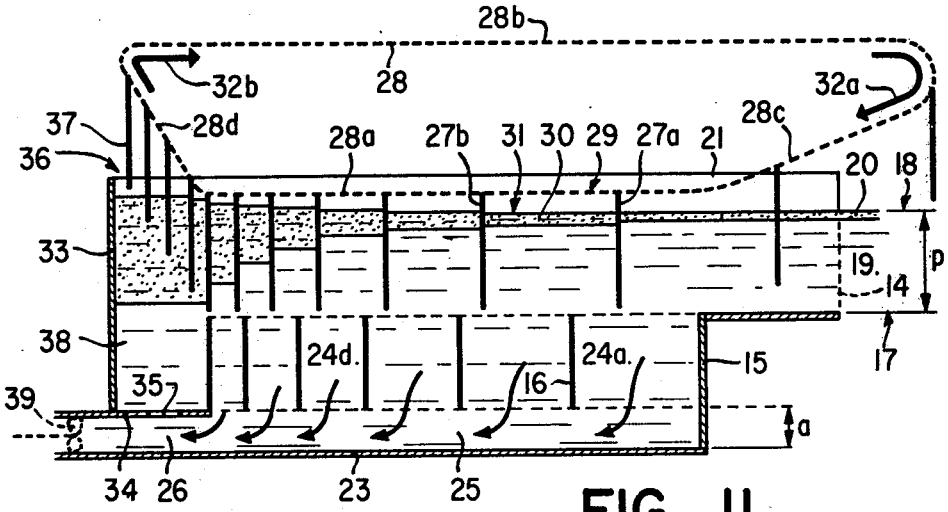
FIG. 11 is a schematic sectional view of a first embodiment of the plant for carrying out the process.

A plant for carrying out this process is very schematically shown in FIG. 11. This plant comprises a basin 15 provided with a plurality of fixed walls 16 located with their tops 17 at a level 17 at a certain depth p below the free surface 18 of the contaminated liquid outside formed by "pure" liquid 19, for example water, covered by a layer 20 of a liquid contaminant, for example oil. The fixed walls 16 are secured to the side walls of the basin 15, only one of these side walls, the side wall 21, being shown in FIG. 11. The bases of the fixed walls 16 are located at a distance a above the bottom 23 of the basin 15. The fixed walls 16 together define a plurality of shafts 24 opening into a discharge space 25 formed by the free space between the bases of the fixed walls 16 and the bottom 23 of the basin 15 and communicating with a discharge channel 26 at the downstream end of the basin 15. Arranged in the upper portion of the basin 15 is a plurality of movable walls 27 which are continuously moved by drive means, not shown, at a variable speed in a closed loop path schematically indicated by the dash line 28 in FIG. 11. The plurality of movable walls 27 comprise partitioning means for transversely partitioning the interior of the upper portion of the basin into a series of substantially non-communicating compartments.

The drive means is so arranged that the bases of the movable walls 27 will pass substantially at the level 17 of the tops of the fixed walls 16 in the useful portion 28*a* of their path of movement in the direction of the arrow 32*a* and so that in the portion 28*b* of their path of movement, in which they are returned to the front of the basin 15 in the direction of the arrow 32*b*, they are out of the liquid. Further, the drive means moves the walls 27 at a speed which is considerably higher in the upstream portion of the basin 15 than in the downstream portion thereof so that the spacing between the walls 27 is progressively reduced toward the outlet end of the basin 15. Accordingly, the partitioning means is operable to progressively advance the series of compartments along the length of the upper portion of the basin away from the open end while simultaneously progressively decreasing the volume of the compartments as they advance. This reduction of the spacing between the walls 27 causes the cells or compartments defined between each pair of adjacent walls 27, for example, the cell formed by the space 29 between the walls 27*a* and 27*b* and the side walls 21 and 22, to behave in the manner described above with reference to FIGS. 7 and 8, i.e. the thickness of the enclosed layer of oil 30 is progressively increased and its free surface 31 is progressively raised. The last one of the fixed walls 16 is connected to the rear wall 33 of the basin 15 by a bottom plate 34 provided with an aperture 35 so as to form a recovery chamber 36 in which the thickness of the accumulated oil 37 is sufficiently great to permit it to be recovered by conventional means, for example, by pumping. The remaining water 38 collecting on the bottom plate 34 is evacuated through the aperture 35 into the discharge channel 26. The water below the layer of oil, which is moved on by the cells 29, is discharged into the various shafts 24 from which it escapes into the discharge space 25 and further through the discharge channel 26. If desired, the discharge channel 26 may be provided with propulsion means such as a propeller 39 to keep the water circulating. If the uncontaminated water contained in the cells is drawn off, the free surface 31 of the liquid may then be kept in a horizontal position by appropriately adjusting the flow rate of the water and by producing a carefully calculated pressure drop in each shaft 24. As the propeller 39 constitutes an optional feature it is drawn in dash lines.

The path of the closed loop 28 comprises an inclined upstream portion 28*c* at the inlet 14 to the basin 15 and an inclined downstream portion 28*d* adjacent the recovery chamber 36. In these loop portions 28*c* and 28*d* the walls 27 remain equidistant so that during their immersion in the loop portion 28*c*, where they are equally spaced widely apart, and during their emerging in the loop portion 28*d*, where they are equally spaced close together, the contaminant layer is not disturbed as would be the case if the spacing between the walls 27 was varied during the immersion or emerging of the walls 27.

If the described plant the movable walls 27 must move at a variable speed. Although many ways are known to produce such a movement, the means for producing such movement are all relatively complex, particularly because the walls have to be recycled, i.e. moved back to the inlet of the basin and simultaneously spaced apart to regain their initial spacing.

Therefore, another plant is proposed according to the present invention, which is schematically shown in FIGS. 12 and 12*b*. In this plant the movable walls are formed by the immerged portions 45 of the helical worm 46 of an Archimedean screw 47 with variable pitch. The axle 48 of the Archimedean screw 47 is arranged in a horizontal position. The Archimedean screw 47 is rotatively driven by any known means, not shown, on the direction of the arrow 44. The pitch of the helical worm 46 decreases from its upstream end toward its downstream end. The fixed walls are in the form of inclined walls 49 which guide the flow of the water in the shafts 50 formed by the spaces between the walls 49. The walls 49 in a certain sense serve as guide blades for the flowing water. The screw 47 is rotatively mounted in a trough 51 which together with the immerged portions 45 of the helical blades 46 of the screw forms the cells 52 in which the contaminated liquid is enclosed. The blades 49 are secured to the trough 51. The bottom 53 of the plant likewise has a hydrodynamic shape to facilitate the flow of the water in the discharge space 54 formed by the free space between the guide blades 49 and the bottom 53. The discharge space 54 communicates with a discharge channel 55 which may be provided with a propeller 56. At the downstream end of the plant there is a recovery chamber 57 having in its bottom wall a discharge aperture 58 through which the water 59, which has accumulated below the oil layer 60, is evacuated into the discharge channel 55.

Removal means, for example, a pump not shown in FIGS. 11 and 12 but shown in FIGS. 13 and 16, is provided for recovering the oil of the thickened layer which accumulates in the recovery chamber 57.

If required, the water may be pumped off. In this case a servo-mechanism is installed which ensures the pumping rate to be adjusted as a function of the position of the interface between water and contaminant so that the pump does not suck in the contaminant.

It will be seen that this type of plant operates in the same manner as that shown in FIG. 11. In effect, the rotation of the screw 47 causes the mass of liquid contaminant enclosed in the cells 52 formed by the spaces between the turns of the screw 47 to move downstream and, as the pitch of the screw 47 decreases toward the downstream end thereof, the cells 52 narrow and the same effect as in the embodiment shown in FIG. 11 is obtained, i.e. the layer of liquid contaminant, in the present case oil, floating on the surface of the contaminated liquid, in the present case water, is progressively thickened.

The delivery of the pump for removing the oil layer 60 from the recovery chamber 57 is regulated by servo control means in such a manner that the suction hose of the pump will remain constantly immerged in the layer of oil so that the interface between oil and water is prevented from rising above a given level and the free surface of the oil is prevented from dropping below another given level. Thus, this servo control means controls the delivery of the pump in dependence on the level of the interface between oil and water and/or on the level of the free surface of the oil.

The screw 47 is also mounted for axial movement in the direction of the arrow 62 to obtain the greatest efficiency of the plant by adapting it to the thickness of the initial layer of oil 20 and to the flow of liquid contaminant at the inlet 61.

The axle 48 of the screw 47 can further be inclined relative to the horizontal plane and this inclination can be varied according to requirements, as indicated by the arrow 63.

The described embodiment has a screw provided with only one helical worm. However, the screw 47 may also be provided with several helical worms the pitches of which decrease from the upstream end toward the downstream end of the screw. The effect obtained thereby is the same on principle, but in this case the speed of rotation of the screw 47 may be reduced and thereby the risk of forming an emulsion of the two liquids is avoided.

The two embodiments of the plant shown in FIGS. 11 and 12, respectively, are designed for fixed installation for the treatment of a contaminant liquid which flows freely toward the inlet thereof. This is the case in the treatment of contaminated water coming from industrial plants and large cities. This is also the case in certain industrial processes in which a light fluid floating in the form of a thin layer on the surface of a heavier liquid is to be removed.

But these plants, especially that with the Archimedean screw, can also be mounted on shipboard to permit the treatment of contaminated waters of rivers, lakes and the sea.

FIG. 13 shows such contaminant removing vessel. Located in the front portion of the hull 65 is a screw system 66 with variable pitch and in the illustrated embodiment with only one worm, this screw being similar to that described with reference to FIG. 12. This screw is driven by a motor 68 with reduction gear for rotation in a cylindrical trough or housing 69 in front of a plurality of vertical partitions 70 similar to the partitions 16 of the plant shown in FIG. 11. The partitions 70 are secured to the trough 69 at heights decreasing progressively from the upstream end to the downstream end of the screw along a line 71 (see FIG. 13*b*) which approximately follows the variation of the interface between the water and the contaminant, for example, water and oil, in the cells 72 formed by the spaces between the spiral blades of the screw 66. The axle 86 of the screw 66 is located slightly above the upper surface 87 of the contaminated water. The screw 66 is longitudinally movable by control means 88 in the reduction gear of the motor 68 so that the longitudinal position of the screw can be varied as shown by the arrow 89 to adapt it to the thickness of the contaminant and/or the speed of the vessel. A recovery chamber 73 is located rearwardly of the screw 66 to collect the contaminant. A pump 74 is provided to pump off the contaminant from the chamber 73 and feed it into a storing basin 75. The water flowing into the shafts 76 formed by the spaces between the partitions 70 is collected in a discharge space 77. The discharge space 77, contrary to the discharge space 25 shown in FIG. 11 and the discharge space 54 shown in FIG. 12, is so arranged that the water is forced to flow in the direction indicated by the arrow 78, i.e. contrary to the direction of flow of contaminated liquid indicated by the arrow 79. The reason for this arrangement will be explained hereinafter. From the discharge space 77 the water flows into a discharge channel 80 under the action of a pump 81 which forces it out of the vessel through a discharge pipe 82 provided on the bottom of the hull below the storing basin 75. A Venturi tube in inserted between the discharge channel 80 and the pump 81 to draw off through a pipe 84 the water 85 which may collect on the bottom of the recovery chamber 73.

The following hydrodynamic considerations constitute the reason why the liquid in the discharge space 77 is forced to flow in a direction opposite to the direction of flow at the inlet of the plant. In fact, if the flow of the liquid through the first shaft 90 is not restrained in some way or another, there is a risk of the entire amount of incoming liquid including the contaminant dropping into the shaft 90. Due to the counter flow below the first shaft 90, the pressure drop therein is increased so as to force the surface layer contaminated liquid to pass on over the second shaft 91. The same applies to the second and the following shafts. Therefore, the passage cross section of the discharge space 77 must be adapted to the flow in the various shafts, which must gradually decrease as the amount of water contained in the masses of liquid in the cells 72 diminishes toward the downstream end of the screw 66.

The flow rate in the various shafts can be adjusted by means of a pair of movable panels 92 and 93 arranged at the bottom of the shafts which jointly comprise discharge control means. This arrangement is shown in detail in FIG. 14 which shows the lower ends of the partitions 70 below which the panels 92 and 93 are arranged. The panels 92 and 93 are positioned between the lower ends of the partitions 70 and the discharge space 77 which opens into the discharge channel 80. The panels 92 and 93 are pivotally mounted at one of their ends on pivots 94 and 95 which permit them to move apart under the action of screws 96 and 97 which are secured to their other ends and threadedly engage a shaft 98 formed of two halves provided with opposed screw threads 101 and 102. In the embodiment illustrated in FIG. 14, the panels 92 and 93 have rectilinear side faces 99 and 100, but according to the invention these side faces may also be curved.

The shaft 98 is arranged in the forecastle of the vessel 98 and can be rotated with the aid of a control means (not shown) to permit the distance between the panels 92 and 93 to be varied as desired, as indicated by the arrows 103 and 104.

Obviously, two or more plants of the type described above may be combined and installed on the same vessel. A few possibilities for such combinations are schematically illustrated in FIG. 15. Thus, the diagram A in FIG. 15 represents in a simplified manner the arrangement described with referene to FIG. 13. In this case the vessel 110 is equipped with a single plant schematically indicated by the block 111, which receives the contaminated water through an inlet 109 and collects the contaminant in a storing basin 112. This vessel is designed for operation in only one direction as indicated by the arrow 114, which is the direction of movement of the vessel when it is driven by its propeller 113.

The diagram B shows a reversible vessel 115 which is capable of travelling in two opposed directions as indicated by the arrows 116 and 117. This vessel is equipped with two similar plants 120 and 121 mounted back to back so that the contaminated water entering the inlet 122 is treated when the vessel travels in the direction of the arrow 116 and the contaminated water entering the inlet 123 is treated when the vessel travels in the direction of the arrow 117. In both cases the plants 120 and 121 discharge the contaminants into a common storing basin 124.

The diagram C in FIG. 15 is a schematic cross section through a pair of plants 125 and 126 mounted side by side in a hull 127 of the catamaran type. With this arrangement the amount of treated liquid can be doubled. Obviously, such a catamaran type hull may contain a pair of double plants such as the pair 125 and 126, one of such pairs being arranged to operate when the vessel is travelling in one direction and the other pair being arranged to operate when the vessel is travelling in the opposite direction.

Evidently, the invention is not limited to this list of possible applications of the process and plants described above. Apart from the described applications in the field of treatment of waste water from industrial plants and large cities and in the field of treatment of contaminated water in rivers, lakes and the sea, the process of the present invention may also be used for any industrial or even domestic treatment in which it is necessary to remove a thin layer of light liquid from the surface of a heavier liquid.

Moreover, the described process and plant, which have been designed for recovering a liquid spread on the surface of another liquid with which the first liquid is immiscible, can also be used for recovering "contaminants" which are not really liquid in the exact sense of this term, but are similar to liquids. Such contaminants may be, for example, emulsions, particularly detergent emulsions, or dusts such as soot or fine grains such as sawdust. In other words, in this manner products floating in a thin layer on the surface of a liquid with which they are immiscible can be recovered, such products having been referred to hereinbefore as "fluids" because they lack cohesion.

With reference to FIG. 11 it has been pointed out that the relative movement of the walls 27 delimiting the cells 29 should not begin before the walls 27 are completely immerged in the liquid and should have stopped before the walls 27 leave the liquid as a variation of the spacing between the walls 27 during their movement into or out of the liquid would produce disadvantageous disturbances of the contaminant layer. The same applies to the plant comprising a screw of variable pitch of the type illustrated in and described with reference to FIG. 12.

For this purpose the plant is modified as shown in FIGS. 16 and 16b which represent a multiple plant mounted on board of a contaminant removing vessel 150 of the catamaran type. In this modified embodiment the screw is made longer and comprises two longitudinal portions in which the pitch is constant. Thus, as shown in FIG. 16, the screw 151 comprises an upstream portion 152, in which the pitch is constant, a centre portion 153, in which the pitch is variable, and a downstream portion in which the pitch is constant. Both portions 152 and 154 with constant pitch extend over lengths which are equal to at least one and a half times the ratio between the pitch P and the number of spiral blades N in the respective screw portions 152 and 154. Thus, the upstream screw portion 152 with constant pitch, in which there are two spiral blades 155 and 156 and the pitch $P_m$ is greatest, extends over a length greater than or equal to $1.5\times(P_M/2.)$ The downstream screw portion 154 with constant pitch, in which the screw has only one spiral blade, as the spiral blade 155 ends at the point 157, and the pitch $P_m$ is smallest, extends over a length greater than or equal to $1.5\times P_m$.

FIG. 16 also shows that it is not indispensable to provide guide blades, such as the guide blades 49 in FIG. 12 in the discharge channel 158 through which the underlying water is discharged. By giving an appropriate shape to the bottom 159 of the discharge channel 158 a perfectly regular flow of the underlying water can be obtained.

Finally, FIG. 16 shows how the screw 151, its trough 159, discharge channel 158, drive motor 161 and the transmission gear 162 connecting the screw 151 to the drive motor 161 can be moved in an axial direction by means of a screw 163 driven by a motor 164, and in an angular direction by means of a screw jack 165 supported by a transverse beam 166. To permit these movements the upstream end 168 of the axle of the screw 151 is shiftably mounted in a bearing 169 capable of pivotal movement about a transverse axle 170.

As in the embodiment shown in FIG. 12, the contaminant 171 accumulates in a recovery chamber 172 in a layer which is much thicker than the initial layer 173. A suction hose 174 connected to a pump, not shown, permits the contaminant to be removed from the recovery chamber 172.

A plant of this type has been mounted in a fixed dam in a laboratory and subjected to tests with fresh water with calm surface and a contaminant formed by Libyan crude oil. The results of the tests were as follows:

| | |
|---|---|
| Libyan crude oil | |
| Density | $\rho = 0.82$ (kg/m$^3$) |
| Viscosity | $\nu = 8.4$ (cS) |
| Temperature | $t = 8.0$ (° C.) |
| Variable pitch rotating screw | |
| Speed of entry | $V_E = 0.4$ (m/s) |
| Speed of rotation | $n_v = 43.0$ (r.p.m.) |
| Flows | |
| Oil at entry | $q_{HE} = 3.60$ (1/mn) |
| Oil at exit | $q_{HS} = 3.58$ (1/mn) |
| Water at exit | $q_{ES} = 0$ (1/mn) |
| Thickness of oil slick at screw intake | |

-continued

| | |
|---|---|
| | $h_{HE} = 0.5$ mm |
| Thickness of oil at screw exit | |
| | $h_{HS} = 60$ mm |
| Efficiency | |
| $\eta_1 = \frac{q_{HS}}{q_{HE}} \cdot 100 = 99.4\%$ | |
| $\eta_2 = \frac{q_{HS}}{q_{HS} + q_{ES}} \cdot 100 = 100\%$ | |

We claim:

1. An apparatus, for hydromechanical recovery of a contaminant spread in a thin layer on the surface of a liquid immiscible with the contaminant, comprising:

an elongated hollow housing having a major length dimension and open at one end and having at least one aperture therethrough along a bottom portion thereof, said elongated housing being partially immersible in use in a body of liquid with its major length dimension generally horizontal for enclosing a volume of liquid within said hollow housing and with said aperture totally immersed in the body of liquid;

partitioning means for partitioning the interior of said housing into a series of compartments which progressively advance along the length of said housing from the open end while simultaneously progressively decreasing in volume as they advance along the length of said housing, said partitioning means defining said compartments open opposite said aperture to provide communication through said aperture between the interior of said compartments and the exterior of said housing to allow fluid entrained within respective ones of said compartments progressively decreasing in volume to flow out of said housing through said aperture for progressively decreasing in each of said respective compartments the volume of liquid entrained therein as said respective compartments are advanced along the length of said housing, said aperture having dimensions effective for flowing therethrough sufficient amounts of underlying liquid from the progressively decreasing in volume advancing compartments to maintain an upper surface of the enclosed contaminant entrained within said compartments at a substantially constant level, and said compartments extending to a depth exceeding the contaminant and the liquid so that the contaminant layer entrained within said compartments progressively thickens as the volumes of the respective compartments decrease and the underlying liquid is discharged through said aperture to facilitate recovery of the contaminant from the surface of the liquid enclosed within said housing; and means defining a recovery chamber at an end of said housing opposite said open end for receiving the thickened contaminant layer for holding the same while it is being recovered from the surface of the underlying liquid.

2. An apparatus according to claim 1, wherein said housing is cylindrical, wherein said partitioning means comprises an Archimedean screw including at least one helical blade having a pitch decreasing from one end of the screw toward the other, and wherein said cylindrical housing encloses said helical blade to prevent communication between the two faces of the helical blade.

3. A plant as claimed in claim 2, wherein the Archimedean screw has at its large-pitched end a screw portion with a constant pitch equal to said large pitch.

4. A plant as claimed in claim 3, wherein said plant is mounted on shipboard, said Archimedean screw is arranged with its axis parallel to the longitudinal axis of the ship with the large-pitched portion of the screw in the prow of the ship, and said screw drive means is effective to drive said screw at a speed such that there is no relative movement of said partitioned portions with respect to the plane of the water until the area of said partitioned portions begins to decrease.

5. A plant as claimed in claim 3, wherein the length of the screw portion with constant pitch at the large-pitched end of the screw is greater than one and a half times the ratio of the value of its constant pitch and the number of its blades.

6. A plant as claimed in claim 2, wherein the Archimedean screw has at its small-pitched end a screw portion with a constant pitch equal to said small pitch.

7. A plant as claimed in claim 6, wherein the length of the screw portion with constant pitch at the small-pitched end of the screw is greater than one and a half times the ratio of the value of its constant pitch and the number of its blades.

8. A plant as claimed in claim 2, wherein the Archimedean screw comprises more than one helical blade.

9. A plant as claimed in claim 2, wherein the number of helical blades of the Archimedean screw at the large-pitched end thereof is greater than the number of helical blades at the small-pitched end thereof.

10. A plant as claimed in claim 2, wherein said discharge channel is provided with guide means for guiding the flow in the discharge channel and for preventing said liquid from being urged from the discharge channel toward said partitioned portions and means for preventing said fluid from being sucked from said partitioned portions toward said discharge channel.

11. A plant as claimed in claim 10, wherein said guide means comprises at least one fixed guide blade immersed in said flow.

12. A plant as claimed in claim 10, wherein said discharge channel comprises walls shaped to form said guide means.

13. A plant as claimed in claim 2, further comprising positioning means permitting the axial position of the Archimedean screw to be adjusted relative to said housing means.

14. A plant as claimed in claim 2, further comprising adjusting means for varying the angle defined between a horizontal line and said common axis of said screw and housing means.

15. A plant for hydromechanical recovery of a contaminant spread in a thin layer on the surface of a liquid immiscible with the contaminant, comprising partitioning means adapted to be immersed into the contaminant and the underlying liquid up to a depth exceeding the interface between the contaminant and liquid so as to horizontally delimit at least one portion of both contaminant and underlying liquid, means for moving at least a part of said partitioning means so as to reduce the area of the partitioned portion, while simultaneously displacing said portion towards a recovery place, means maintaining respective upper surfaces of said partitioned portion of contaminant and underlying liquid at a substantially constant level during the displacing of said partitioned portion, and recovery means in this recovery place for recovering the contaminant contained in said portion of reduced area, wherein said partitioning means comprises an Archimedean screw provided with at least one helical blade having a pitch decreasing from one end of the screw toward the other, and cylindrical housing means enclosing said helical blade to prevent communication between the two faces of said helical blade, said screw and housing means being arranged so that their common axis extends in a substantially horizontal direction and that the helical blade is immersed into said contaminant and underlying liquid up to a depth less than the radius thereof, means defining a discharge channel, the interior of said housing means communicating with said discharge channel through at least one aperture provided below said screw and having its upper edge located at a depth below the interface between said contaminant and underlying liquid, the adjacent immersed portions of said helical blade and the immersed portion of said housing means defining therebetween said portions of contaminant and underlying liquid, whose area is determined by the pitch of said belical blade, said moving means comprising drive means for rotating the screw within said housing means in a direction such that said contaminant and underlying liquid is progressively moved from the largepitched end of the screw to the small-pitched end thereof, towards said recovery place.

16. In a ship having a hull, apparatus within the ship hull for recovering an immiscible contaminant spread on a surface of a body of water in which the ship floats in use, which apparatus comprises: an elongated cylindrical housing having a major length dimension and open at one end and having at least one aperture along a bottom portion thereof; a chamber beneath said cylindrical housing with the aperture of said cylindrical housing opening into said chamber; intake means for delivering water from the surface of the body of water in which the ship floats in use to the open end of said elongated cylindrical housing; an Archimedean screw including at least one helical blade having a pitch decreasing from one end of the screw toward the other, said Archimedean screw being disposed within said housing coaxially therewith and with the screw pitch decreasing in a direction away from the open end of said housing, said Archimedean screw having a diameter to permit axial rotation of said screw within said housing and to effectively partition the interior of said housing into a series of substantially non-communicating compartments of successively smaller volume each open at the aperture of said housing and being in communication therethrough with the interior of said chamber, said screw blade partitioning water within said housing into partitioned sections each within a respective one of said compartments and partitioning a contaminant layer on a surface of the water into partitioned sections overlying respective partitioned sections of the water; mounting means mounting said Archimedean screw in said housing coaxially therewith for axial rotation in said housing; driving means operable for driving said screw to axially rotate in a direction to advance the partitioned portions of water entrained within the compartments along the length of said housing in a direction away from the open end of said housing and in the direction of decreasing pitch of said Archimedean screw, the decreasing pitch of said Archimedean screw being effective to progressively decrease the volume of the respective partitioned portions of entrained water as they advance along the length of said housing by flowing the water within said housing out through said aperture and into said chamber to maintain respective upper surfaces of partitioned contaminant layer portions overlying said partitioned portions of water at a substantially constant level, and the respective partitioned portions of contaminant layer progressively thickening as they advance along the length of said housing within the compartments of progressively decreasing volume; discharge means defining a discharge channel for discharging the water, received in use by said chamber, into a body of water in which the ship is floating; and recovery means for recovering the thickened layer of contaminant from the interior of said housing at an end thereof remote from said open end.

17. In a ship having a hull, apparatus according to claim 16, wherein said chamber beneath said housing includes a plurality of vertical partitions extending transversely within said chamber and disposed at intervals along the length of said housing which intervals successively decrease in a direction away from the open end of said housing, pairs of successive ones of said partitions defining therebetween open vertical shafts open opposite the aperture through the bottom portion of said housing and open opposite a bottom of said chamber for flowing therethrough water flowing from the interior of said cylindrical housing through said aperture; discharge control means disposed within said chamber and defining a discharge space within said chamber at the bottom thereof beneath said partitions, said discharge control means being operable for controlling a flow of water flowing from said housing through said aperture and through said vertical shafts into said discharge space in order to control a level of water within said cylindrical housing, and means defining a discharge duct for slowing water from said discharge space.

18. In a ship having a hull, apparatus according to claim 17, wherein said discharge control means comprises a pair of horizontal panels disposed substantially coplanar and opposite each other, and mounting and positioning means mounting said pair of panels horizontally within said chamber to define said discharge space between the bottom of said chamber and said pair of panels and being operable to relatively position said pair of panels horizontally for setting a space between said pair of horizontal panels to place the vertical shafts defined between pairs of said vertical partitions in communication with said discharge space through the space between said pair of horizontal panels.

19. In a ship having a hull, apparatus according to claim 16, further comprising a recovery chamber at the end of said cylindrical housing remote from said open end and connected therewith for receiving the thickened portion of contaminant layer advanced by said Archimedean screw to the end of said cylindrical housing remote from said open end, and for receiving water advanced along with the thickened portion of contaminant, wherein said recovery means is disposed within said recovery chamber to recover the thickened contaminant layer therefrom; a pipe connecting said recovery chamber with said discharge duct for flowing water out from said recovery chamber into said discharge duct; and means defining a venturi constriction within said discharge duct for developing in use a pressure drop within said discharge duct to effectuate flow of water from said recovery chamber through said pipe and into said discharge duct.

20. In a ship having a hull, apparatus according to claim 16, wherein said mounting means mounts said Archimedean screw for rotation within said housing and to be positionable axially within said housing relative thereto, and further comprising positioning means for axially positioning and changing the axial position of said screw within said housing.

21. In a ship having a hull, apparatus according to claim 16, further comprising within said hull storage means for storing the recovered liquid contaminant.

22. In a ship having a hull, apparatus exterior to the ship hull for recovering an immiscible contaminant spread on a surface of a body of water in which the ship floats in use, said apparatus comprising: a housing including an elongated cylindrical portion having a major length dimension and open at one end and having at least one aperture along a bottom portion of the cylindrical portion, and including a bottom wall underlying and spaced from the bottom portion of the cylindrical portion and defining therebetween a discharge channel in communication with the interior of the cylindrical portion through the aperture, said housing being immersible in use in a body of water in which the ship floats for flowing water and contaminant into said cylindrical portion through the open end thereof and from the interior of said cylindrical portion through said aperture into said discharge channel; an Archimedean screw including at least one helical blade having a pitch decreasing from one end of the screw toward the other, said Archimedean screw being disposed within said cylindrical portion coaxially therewith and with the screw pitch decreasing in a direction away from the open end of said cylindrical portion, said Archimedean screw having a diameter to permit axial rotation of said screw within said cylindrical portion and to effectively partition the interior of said cylindrical portion into a series of adjacent substantially non-communicating compartments of successively smaller volume each open at the aperture of said cylindrical portion and each in communication with said discharge space through said aperture, said screw blade partitioning water within said cylindrical portion into separate portions each within a respective one of said compartments and partitioning a contaminant layer on a surface of the water into separate portions overlying respective portions of the water; mounting means mounting said Archimedean screw in said cylindrical portion coaxially therewith for axial rotation in said housing; driving means for driving said screw to rotate axially in a direction to advance the separate portions of water entrained within the corresponding compartments along the length of said cylindrical portion in a direction away from the open end of the cylindrical portion and in the direction of decreasing pitch of said Archimedean screw, the decreasing pitch of said screw being effective to progressively decrease the volume of the respective partitioned portions of entrained water as they advance along the length of said cylindrical portion by flowing the water within said cylindrical portion out through said aperture and into said discharge channel to maintain respective upper surfaces of portions of contaminant layer overlying said separate portions of water at a substantially constant level, and the respective portions of contaminant layer progressively thickening as they advance along the length of said cylindrical portion within the compartments of progressively decreasing volume; and recovery means for recovering the thickened layer of contaminant from the interior of said housing at an end thereof remote from said open end.

23. In a ship having a hull, apparatus according to claim 22 exterior to the ship hull, wherein said ship hull is of the catamaran type having two transversely spaced hull sections and said apparatus is between the two hull sections.

24. In a ship having a hull, apparatus according to claim 22, wherein said mounting means mounts said Archimedean screw for rotation within said cylindrical portion and to be positionable axially within said housing relative thereto, and further comprising positioning means for axially positioning and changing the axial position of said screw within said cylindrical portion.

25. A method of recovering a contaminant spread in a thin layer on a surface of a liquid immiscible with the contaminant, comprising:

(a) providing an elongated housing having a major length dimension, and open at one end and having at least one aperture therethrough along a bottom portion of said housing for providing communication between the interior and the exterior of said housing, and partitioning means for transversely partitioning the interior of said housing into a series of substantially non-communicating compartments, each open at said aperture and in communication with the exterior of said housing through said aperture, said partitioning means being operable to progressively advance the series of compartments along the length of said housing away from said open end while simultaneously progressively decreasing the volume of said compartments as they advance along the length of said housing;

(b) immersing said housing and said partitioning means in a liquid, having an immiscible contaminant spread in a thin layer on a surface of the liquid, to a sufficient depth to totally submerse said aperture in the underlying liquid with the liquid and contaminant layer partially filling said housing, and to a sufficient depth to partially fill the series of compartments with the liquid in which said housing and said partitioning means are immersed with said compartments extending beyond an interface between the contaminant and the underlying liquid to define partitioned portions of contaminant layer and respective underlying partitioned portions of liquid within respective ones of the compartments within said housing, and with the major length dimension of said housing generally horizontal;

(c) operating said partitioning means while said housing and said partitioning means are immersed in the liquid for progressively decreasing the total volume of the partitioned portions of contaminant and underlying liquid entrained within the respective progressively advancing compartments in order to progressively thicken the contaminant layer and flow the entrained underlying liquid out of the compartments for progressively diminishing the volume of underlying liquid within the respective advancing compartments to progressively decrease within each respective compartment the total volume of entrained contaminated layer and underlying liquid displaced by said partitioning means as the contaminant layer is being progressively thickened, and said at least one aperture having dimensions effective for flowing therethrough sufficient amounts of underlying liquid from the progressively decreasing in volume advancing compartments to maintain an upper surface of the progressively thickening partitioned portions of contaminant layer at a substantially constant level within said housing; and (d) recovering the respective thickened partitioned portions of the contaminant layer when each of the respective advancing compartments has advanced to the end of said housing opposite said open end.

26. A method of recovering a contaminant according to claim 25, wherein:

(a) said housing is an elongated cylindrical housing, and said partitioning means comprises an Archimedean screw including an axel and at least one helical blade having a pitch decreasing from one end of the screw toward the other and having a diameter slightly less than an inner diameter of said elongated cylindrical housing, said Archimedean screw being disposed within said cylindrical housing extending along the length thereof and mounted for rotation about said axel, successive turns of said blade defining therebetween successive compartments of the series of compartments defined within said housing; and (b) wherein the step of operating said partitioning means comprises rotating said Archimedean screw about said axel in a direction effective to advance partitioned portions of contaminant and underlying liquid entrained between successive turns of said blade for advancing the partitioned portions along the length of the cylindrical housing and away from the open end of the housing.

* * * * *